United States Patent [19]

Wakeman

[11] Patent Number: 4,887,562

[45] Date of Patent: Dec. 19, 1989

[54] MODULAR, SELF-CONTAINED HYDRAULIC VALVE TIMING SYSTEMS FOR INTERNAL COMBUSTION ENGINES

[75] Inventor: Russell J. Wakeman, Newport News, Va.

[73] Assignee: Siemens-Bendix Automotive Electronics L.P., Troy, Mich.

[21] Appl. No.: 250,180

[22] Filed: Sep. 28, 1988

[51] Int. Cl.[4] ..... F01L 9/02

[52] U.S. Cl. ..... 123/90.12; 123/90.16

[58] Field of Search ..... 123/90.12, 90.13, 90.16, 123/90.22, 90.4

[56] References Cited

U.S. PATENT DOCUMENTS

| | | | |
|---|---|---|---|
| 1,930,260 | 10/1933 | Almen | 123/90.13 |
| 2,277,418 | 3/1942 | Simson | 123/90.12 |
| 3,405,699 | 10/1968 | Laas | 123/90.12 |
| 4,153,016 | 5/1979 | Hausknecht | 123/90.12 |
| 4,278,233 | 7/1981 | Zurner et al. | 123/90.12 |
| 4,615,306 | 10/1986 | Wakeman | 123/90.16 |
| 4,716,863 | 1/1988 | Pruzan | 123/90.12 |
| 4,762,095 | 8/1988 | Mezger et al. | 123/90.12 |

FOREIGN PATENT DOCUMENTS

| | | | |
|---|---|---|---|
| 2814185 | 10/1979 | Fed. Rep. of Germany | 123/90.16 |
| 2468733 | 5/1981 | France | 123/90.16 |
| 303031 | 3/1930 | United Kingdom | 123/90.12 |

*Primary Examiner*—David A. Okonsky
*Assistant Examiner*—Weilun Lo
*Attorney, Agent, or Firm*—Russel C. Wells; George L. Boller

[57] ABSTRACT

Self-contained hydraulic variable valve timing systems for use with internal combustion engines include an especially adapted valve cover which integrally includes a hydraulic lifter, a solenoid valve, and fluid passageways fluid connecting the lifter and solenoid valve. In one embodiment, separated cam follower and valve actuating pistons form respective fluid-connected chambers in a case integral with the valve cover, these chambers also being in fluid communication with the solenoid valve via a control passageway. Cam-following motion of the cam follower piston may be hydraulically transferred to the valve actuating piston when the selenoid valve is operated so as to open one valve of the engine, or to simultaneously open a number of valves. An overhead cam may be mounted within the valve cover with the hydraulic lifters disposed between the cam and the valves of the engine. The valve cover will therefore define the fluid passageways so as to operatively interconnect the solenoid valve in the cover to the hydraulic valve lifters.

11 Claims, 4 Drawing Sheets

MODULAR, SELF-CONTAINED HYDRAULIC VALVE TIMING SYSTEMS FOR INTERNAL COMBUSTION ENGINES

FIELD OF THE INVENTION

This invention generally relates to the field of internal combustion engines of the type which employ hydraulic valve lifters. In specific forms, the invention is embodied in modular, self-contained hydraulic valve lifter systems which are especially adapted to vary the timing and duration of valve opening (i.e., a so-called "lost motion" valve timing system).

BACKGROUND AND SUMMARY OF THE INVENTION

Hydraulic valve lifters have been utilized for some time so as to vary timing and duration of valve opening so as to provide more optimum engine performance at various operating conditions. One such system employing hydraulic valve lifters is disclosed in U.S. Pat. No. 4,615,306 entitled "Engine Valve Timing Control System" of Russell J. Wakeman, issued Oct. 7, 1986 (the entire contents of this prior patent being expressly incorporated hereinto by reference and referred to hereinbelow as "the Wakeman '306 patent"). In the Wakeman '306 patent, valve timing and valve opening duration are controlled via pressure pulses developed within the engine oil supply as a result of lifter operation. The valve lifters themselves include a collapsible hydraulic link controlled by a solenoid.

In a particular embodiment (see FIG. 6 of the Wakeman '306 patent), a pair of pistons defines therebetween a chamber which communicates with the solenoid. As the lower piston is being moved up the cam's profile, oil is pushed out of the lifter into bleed passageways until the lower piston's displacement is to be hydraulically transferred to the upper piston as dictated by an electronic control unit (ECU), at which time the solenoid is energized thereby forming a solid hydraulic link coupling the motion of the lower piston to the upper piston which, in turn, actuates valve opening.

By means of the present invention, modular, self-contained hydraulic valve timing systems are provided which embody the beneficial functions of the Wakeman '306 patent. Specifically, cast valve covers according to this invention are provided with a solenoid valve, hydraulic valve lifters, and internal hydraulic passageways which fluid connect the solenoid valves and valve lifters.

Hence, according the the present invention, the hydraulic circuitry for the valve timing system is self-contained within an integral enclosure (i.e., the valve cover) so that during engine production, the valve cover may simply be coupled to the engine block with the electrical leads from the engine control unit (ECU) then being connected to the solenoid valve. As may be appreciated, these modular hydraulic valve timing systems of the present invention may be used by original equipment manufacturers (OEM's) in their original production engines, or may be employed to "retrofit" existing engines to provide them with variable valve timing capabilities.

These, and other, advantages and aspects of the present invention will become more clear after careful consideration is given to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
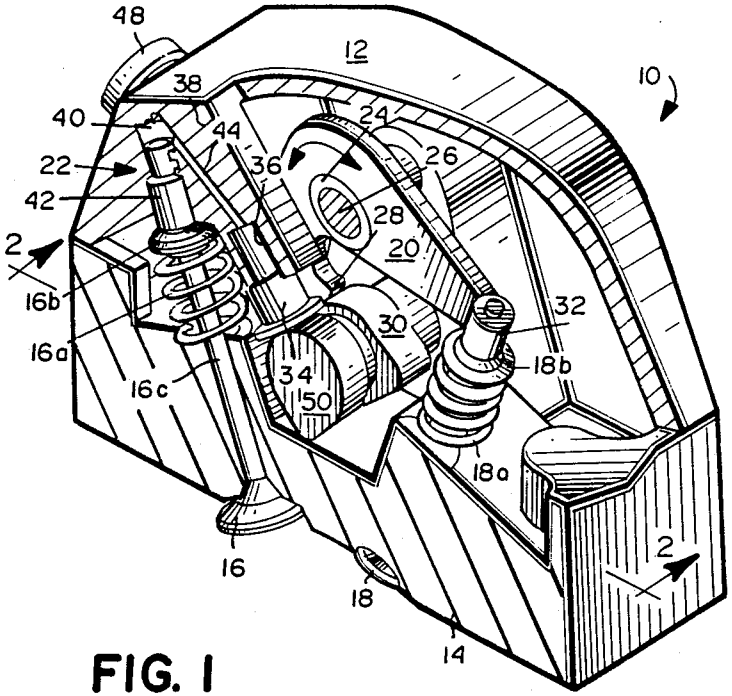
FIG. 1 is a partial perspective view of a self-contained hydraulic valve timing system according to this invention shown in operative association with an intake and exhaust valve of an internal combustion engine.
Figure 2:
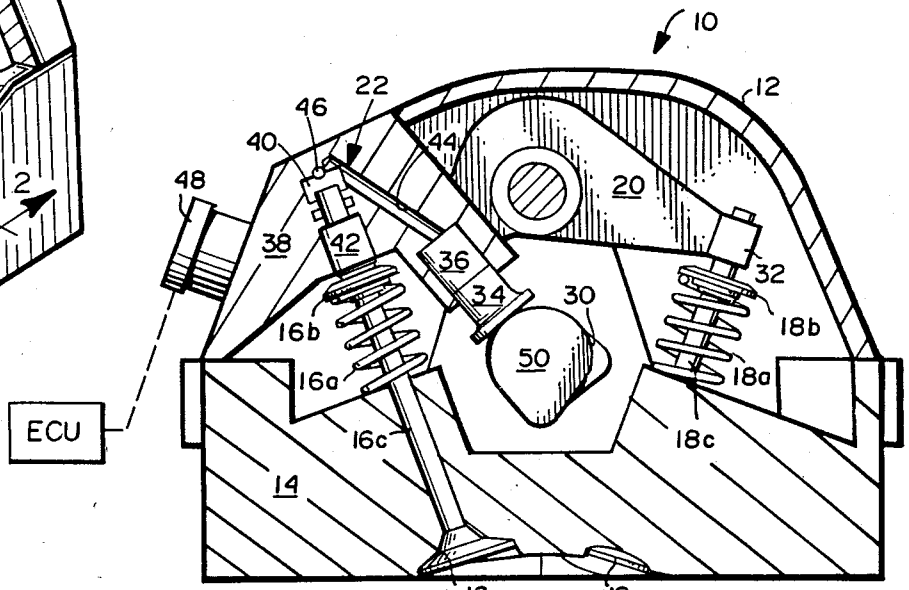
FIG. 2 is an end elevational view of the system shown in FIG. 1 as taken along line 2—2 therein.

An exemplary embodiment of a self-contained hydraulic valve timing system 10 according to this invention is shown in accompanying FIGS. 1 and 2. The system 10 shown in FIGS. 1 and 2 is particularly useful in those engines where the engine designer desires variable valve timing for either the intake or exhaust valves, with the other valves being lifted according to fixed valve timing (as by means of conventional rocker arms or the like).

As is seen in FIGS. 1 and 2, the system 10 includes a valve cover 12 coupled to valve block 14 in which the intake and exhaust valves 16, 18 are reciprocally movable. The valves 16, 18 include compression springs **16*a*, 18*a* and spring caps 16*b*, 18*b*, respectively. The springs 16*a*, 18*a* thus bias the valves 16, 18, respectively, into their closed or seated positions as shown in FIGS. 1 and 2. Although just one intake valve 16 and one exhaust valve 18 is shown in FIGS. 1 and 2 for clarity of presentation, it will be understood that sets of valves 16/18** will be present for each cylinder in the engine.

In the embodiment shown, a rocker arm 20 is operatively associated with the exhaust valve 18 while a hydraulic lifter assembly 22 is operatively associated with the intake valve 16. However, if desired, the hydraulic lifter assembly 22 could be associated with only the exhaust valve 18 (in which case the rocker arm is operatively associated with the intake valve 16) or with both the intake and exhaust valves 16 and 18, respectively. The rocker arm is mounted via bearing 24 for pivotal movements about shaft 26. One end 28 of the rocker arm 20 follows the profile of the cam 30 while its other end 32 is in contact with the stem **18*c* of valve 18. As is well known, the valve 18 will be unseated and seated in response to rotation of the cam 30 due to the motion transfer functions provided by the rocker arm 20. The rocker arm 20 thus provides fixed (i.e., not variable) timing and duration of valve 18 opening in strict compliance with the profile of the cam 30**.

Variable timing and duration of opening however may be provided for the intake valve 16, for example, by means of the hydraulic lifter assembly 22. The lifter assembly 22 includes a cam follower piston 34 received within a cylindrical bore 36 of the hydraulic case 38 unitarily formed in the valve cover 12 so as to be capable of sliding reciprocal movements therewithin. The case 38 also defines a bore 40 which receives a valve actuating piston 42. In practice, the valve actuating piston 42 is preferably comprised of a pair of pistons capable of adjusting valve lash and damping motion of the valve 16 during its closure to seat as is described more fully in U.S. Pat. No. 4,796,573 issued on Jan. 10, 1989 in the names of Russell J. Wakeman and Stephen F. Shea and entitled "Hydraulic Engine Valve Lifter Assembly" (the entire content of this copending application being expressly incorporated hereinto by reference).

A passageway 44 defined within the case 38 fluid connects the bores 36 and 40 and thus provides a hydraulic link between the pistons 34 and 42. Similarly, a passageway 46 (see FIG. 2) fluid connects the passageway 40 to an inlet of the solenoid valve 48. The profile of the rotating cam 50 will thus cause the cam follower piston 34 to be reciprocally displaced within the bore 36. Specifically, during an opening cycle of the valve 16, the profile of cam 50 will push the cam follower piston 34 into the bore 36 and thus displace oil therein through the outlet (not shown) of the deenergized solenoid valve 48 via communicating passageways 44 and 46. In other words, with the solenoid 48 deenergized, the displacement of the cam follower piston 34 will not be transferred hydraulically to the piston 42.

When the ECU (see FIG. 2) determines that the valve 16 is to be opened, a signal will be issued to the solenoid valve 48 thereby energizing the same. At this time, the flow of oil from the outlet of the solenoid 48 is stopped, and thus a solid hydraulic link is then established between the pistons 34 and 42 via the communicating passageway 44 and the bore 40. Thus, further displacement of cam follower piston into bore 36 will be transferred via this established solid hydraulic link to the piston 42 which then responsively opens the valve 16 (i.e., due to the piston 42 being extended from bore 40 against the stem 16*c* of valve 16).

Although any suitable (i.e., sufficiently responsive) solenoid valve 48 may be employed, it is presently preferred that it be of the type disclosed in commonly owned U.S. patent application Ser. No. 247,999 filed on Sept. 22, 1988, in the name of Morse N. Taxon and entitled "High Pressure, Fast Response, Pressure Balanced Solenoid Control Valve", the entire content of that commonly owned application being expressly incorporated hereinto by reference.

Figure 4:
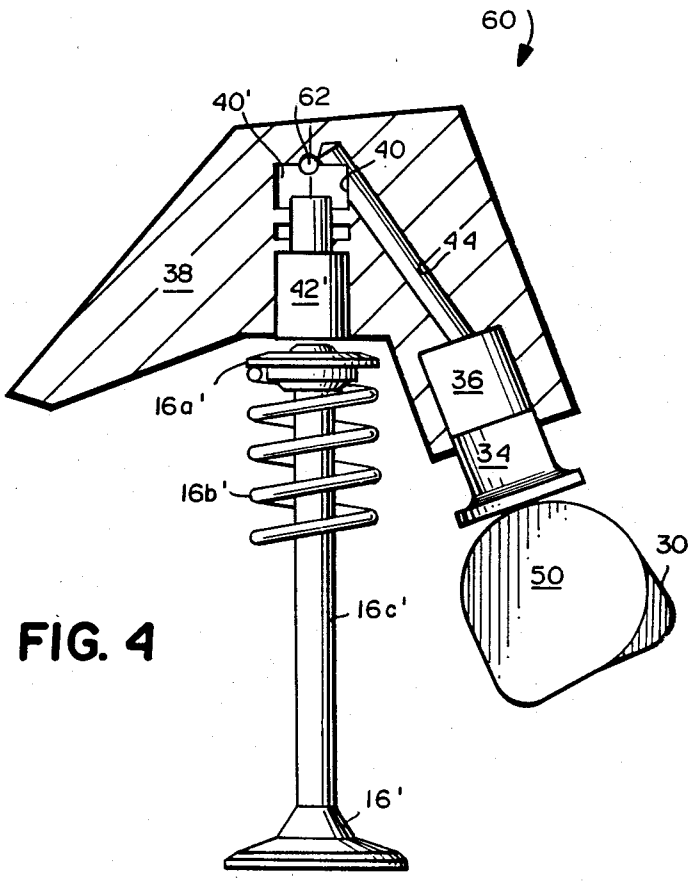
FIG. 4 is a is an end elevation view of the system shown in FIG. 3 as taken along line 4—4 therein.
Figure 3:
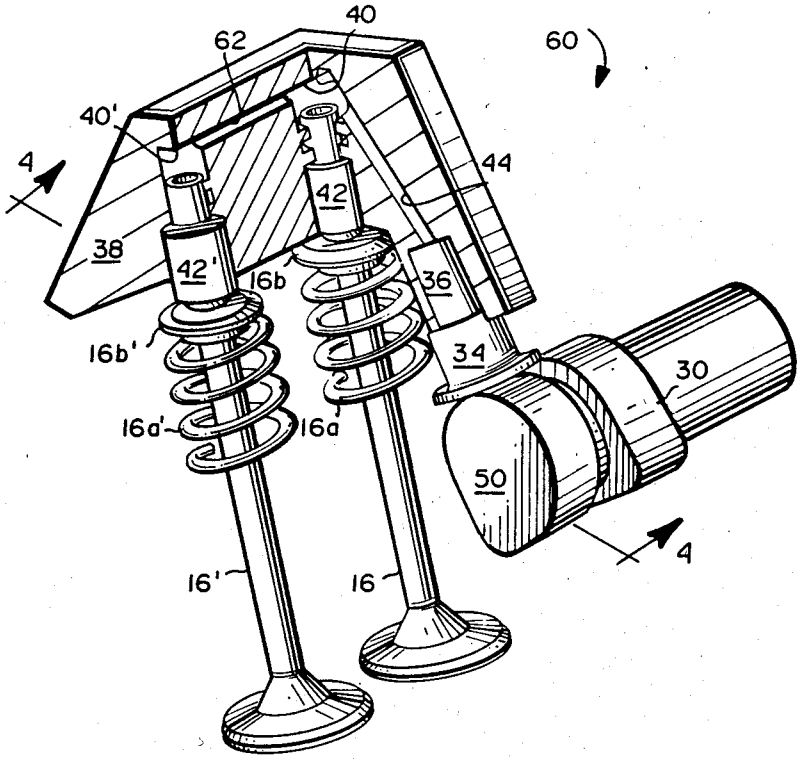
FIG. 3 is partial perspective view of another embodiment of a self-contained hydraulic valve timing system according to this invention.

The system 60 shown in accompanying FIGS. 3 and 4 is similar to system 10 described above with reference to FIGS. 1 and 2. However, the system 60 is suitable to actuate a pair of intake valves 16, 16' via a solid hydraulic link established with a single cam follower piston 34. Thus, the system 60 is particularly well suited for use in an engine having 3 or 4 valves per cylinder.

The structures employed in the system 60 are virtually identical to those employed in the system 10 described above, save the interconnecting passageway 62 in the former. As will be appreciated, a solid hydraulic link established between the cam follower piston 34 on the one hand and each of the valve actuating pistons 42 and 42' on the other hand, will cause each of the valves 16 and 16' to be opened due to the hydraulic communication provided by means of passageway 62.

It should be noted here that although FIG. 3 depicts the passageway 44 terminating at the bore 40 with the passageway 62 then being "daisy chained" from the bore 40 to the bore 40', in practice, the passageway will preferably symmetrically intersect (and thus communicate with) the passageway 62 so as to ensure hydraulic balance as between the pistons 42 and 42'. Thus, the physical location of the passageway 44 in FIGS. 3 and 4 is depicted for the purpose of ease of discussion.

Figure 6:
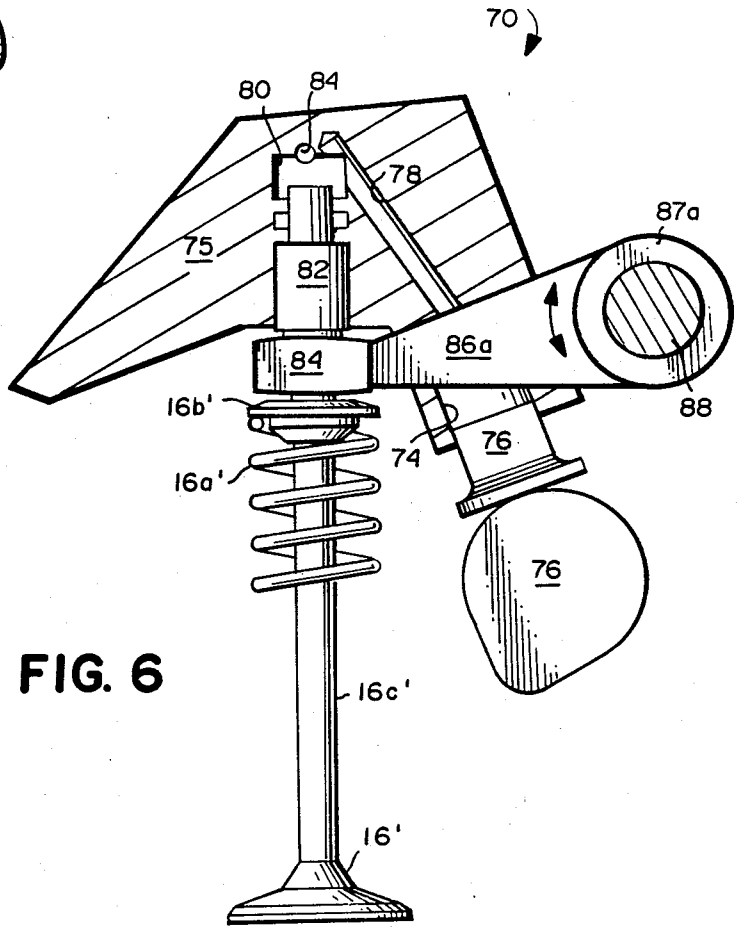
FIG. 6 is a is an end elevational view of the system shown in FIG. 5 as taken along line 6—6 therein.
Figure 5:
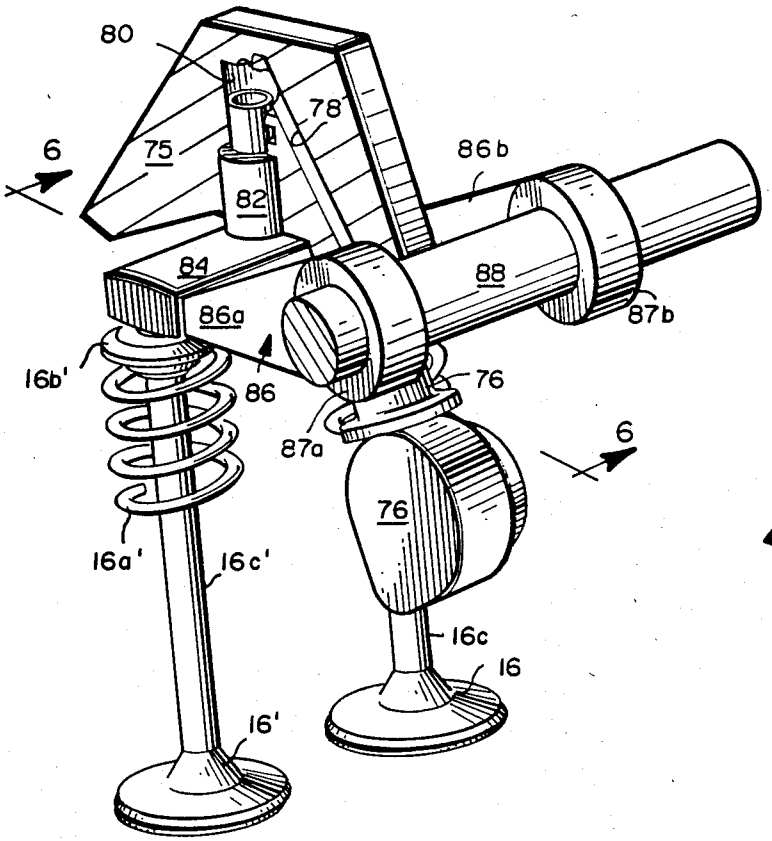
FIG. 5 is a partial perspective view of yet another embodiment of a self-contained hydraulic valve timing system according to this invention.

Another system 70 according to this invention which, like system described above with reference to FIGS. 3 and 4, is adapted to being used in an engine having 3 or 4 valves per cylinder, is shown in accompanying FIGS. 5 and 6. In this regard, the hydraulic lifter 70 shown in FIGS. 5 and 6 is virtually identical to the lifter 22 described previously with reference to FIGS. 1 and 2, in that a cam follower piston 73 is slidably received within a chamber 74 (see FIG. 6) defined in a casing 75 for reciprocal movements therewithin (i.e., in dependence upon the rotation of cam 76). A passageway 78 fluid connects the chamber 74 with a chamber 80 in which a valve actuating piston 82 is received for movements therewithin. A control passageway fluid connects the chamber 80 with the inlet of an ECU-actuated solenoid (not shown) so that a solid hydraulic link may be established as between the pistons 73 and 82 when the valves 16 and 16' are to be opened.

The valve actuating piston 82 is in contact with the end bar 84 of a forked rocker arm 86. Each of the arms 86*a*, 86*b* of rocker arm 86 is attached for pivotal movements about rocker arm shaft 88 via bearings 87*a*, 87*b*, respectively. In operation therefore (i.e., with the establishment of a solid hydraulic link between the pistons 73 and 82) the piston 82 will extend from its chamber 80 and will responsively downwardly (as viewed in FIGS. 5 and 6) pivot end 84, thereby simultaneously opening both valves 16 and 16'.

The systems 10, 60, and 70 are each especially adapted for use in V-configured engines—that is, an engine have right and left banks of cylinders symmetrically disposed laterally of the cam shaft and oriented relative to one another in a V-shape as viewed from the end of the engine.

Figure 7:
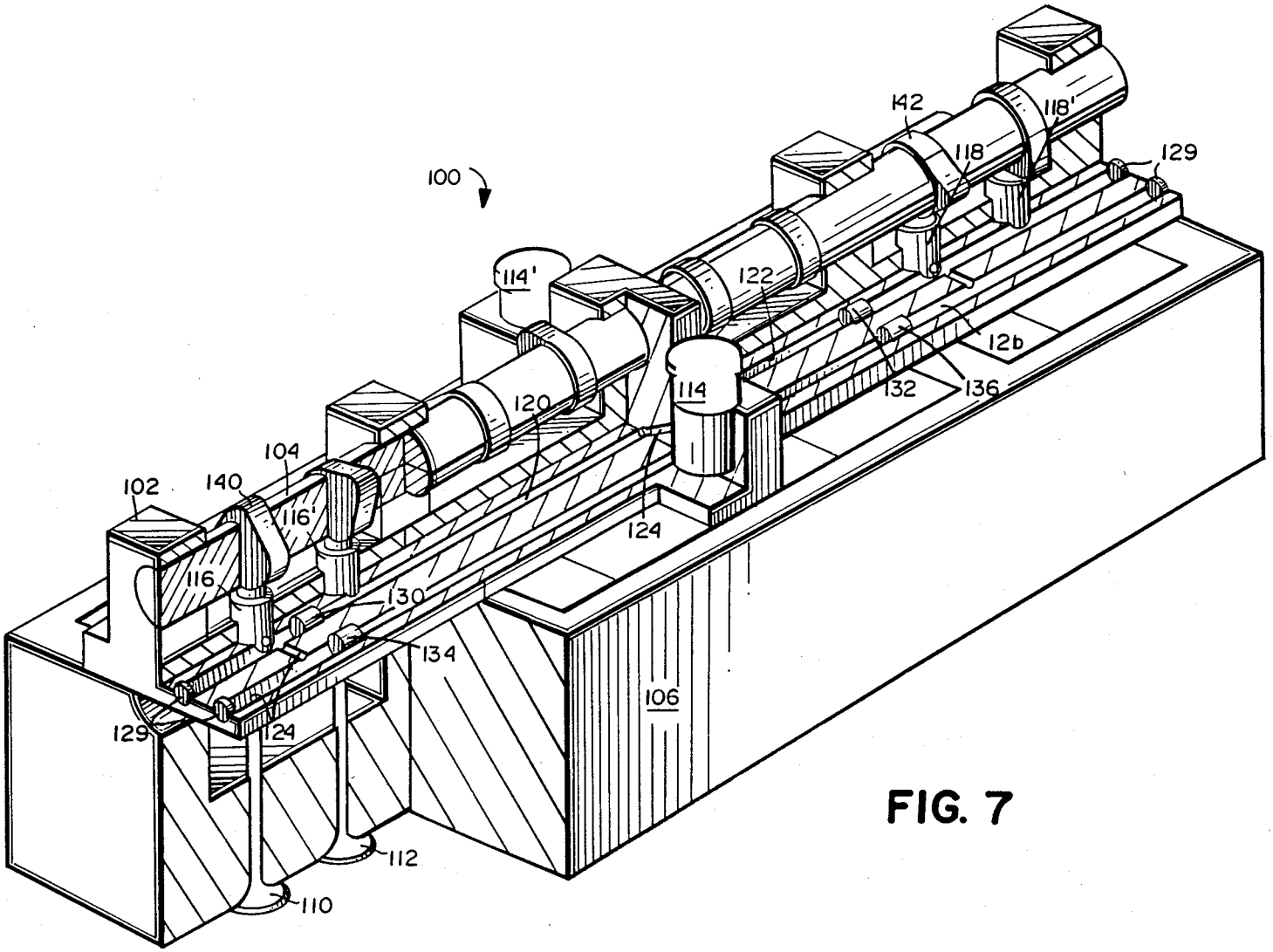
FIG. 7 is a schematic perspective view of a self-contained hydraulic valve timing system according to this invention which is particularly useful for overhead cam type engines.

The self-contained hydraulic valve timing system 100 shown in accompanying FIG. 7, however, is especially adapted for use in overhead cam, in-line type engines. The system 100 of FIG. 7 just happens to be shown in relation to a four cylinder overhead cam engine, it being understood that it is not to be considered limited to the particular engine type shown.

The hydraulic circuitry of the system 100 is self-contained within the valve cover 102 (which also mounts the cam shaft 104 for rotational motion therewithin) coupled to the valve block 106. The valve block 106 is partially sectioned in FIG. 7 so as to expose the intake and exhaust valves 110, 112, respectively, associated with cylinder no. 1 of the engine. In addition, the valve cover 102 is partially sectioned so as to show the hydraulic control passageways which serve to control the opening of the intake valve 110 associated with cylinder no. 1 and a similar intake valve (not shown) associated with cylinder no. 4. It is to be understood that similar, but mirror image, hydraulic control passageways are provided in the system 100 so as to open intake valves associated with cylinder nos. 2 and 3. Hence, the discussion which follows is equally applicable to such similar hydraulic control passageways for cylinder nos. 2 and 3.

As is seen, the system 100 includes a solenoid valve 114 which establishes a solid hydraulic link within the hydraulic lifters 116, 118 associated with the intake valves of cylinder nos. 1 and 4 (only intake valve 110 of cylinder no. 1 being visible). Similarly, the solenoid 114' will control the intake valves (not shown) for cylinder nos. 2 and 3. Preferably, the lifters 116 and 118 (in addition to the exhaust valve lifters 116' and 118') are each of the type disclosed in previously mentioned U.S. Pat. No. 4,796,573. The inlet to the solenoid valve 114 is fluid connected to hydraulic control passageways 120, 122 via passageway. The outlet of the solenoid valve 114 is fluid connected to return hydraulic passageways 124, 126 and communicates with the engine oil system via a passageway not shown in FIG. 7. The terminal end of each passageway 120, 122, 124, and 126 is closed by means of plug elements 129.

Check valves 130, 132, 134 and 136 are operatively provided in the hydraulic control passageways 120, 122, 124 and 126. As is described in greater detail in the Wakeman '306 patent, as the lifter 116 and 118 collapse (i.e., due to the opening ramp of their respective cams 140, 142 bearing against the cam follower pistons associated with the lifters 116 and 118), oil will be forced out of the lifters 116, 118 and into the respective control passageways 120, 122 through the check valves 130, 132, respectively. The oil then enters the open solenoid valve 114 via passageway 124 and is discharged through the outlet of the solenoid valve 114 to the engine oil system. Upon energization of solenoid valve 114, a solid hydraulic link will be established in the lifters 116 and 118. However, since one of the lifters 116, 118 will be on the opening ramp of their respective cams 140, 142, while the other is on its base circle, only one of the intake valves is opened. The other (inoperative) lifter is then "pump up" to return it to zero lash due to hydraulic pressure pulses developed in the return passageways 124 or 126.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A modular self-contained hydraulic variable valve timing system for use with an internal combustion engine of the type having an engine block which includes a rotatable cam shaft, and sets of intake and exhaust valves respectively operatively associated with combustion cylinders of said engine, said modular self-contained variable valve timing system comprising:

a valve cover adapted to being coupled to said engine block in covering relationship to said intake and exhaust valves;

said valve cover having an integral case;

said case including a first open-ended bore in opposing relationship to a cam of said cam shaft, and a second open-ended bore in opposing relationship to a valve stem of one of said intake and exhaust valves, and means which fluid-connect said first and second bores so as to establish a hydraulic transfer path therebetween;

cam follower piston means received within, and closing, said first bore for following a profile of said cam and being reciprocally displaced within said first bore in response thereto;

valve actuating piston means received within, and closing, said second bore and being in opposing relationship to said stem associated with said one valve;

a control passageway in fluid communication with said hydraulic transfer path; and solenoid valve means fluid-connected to said control passageway and having first and second operative states for variably controlling timing and duration of said one valve opening wherein (i) said first state of said solenoid valve means allows said cam follower piston means, during a predetermined first portion of said cam profile being followed thereby, to be collapsibly displaced within said first bore without said collapsible displacement being hydraulically transferred, via said hydraulic transfer path, to said valve actuating piston means, and (ii) said second state of said solenoid valve means establishes a solid hydraulic link, during a predetermined second portion of said cam profile, between said cam follower piston means and said valve actuating piston means such that continued collapsible displacement of said cam follower piston means during said second portion of said cam profile being followed thereby is hydraulically transferred, via said hydraulic transfer path, to cause valve actuating piston means to be responsively displaced within said second bore and into operative engagement with said stem of said one valve thereby opening the same, whereby the timing and duration of said one valve opening is achieved.

2. A self-contained hydraulic valve timing system as in claim 1, wherein said case includes a third open-ended bore in opposing relationship to a valve stem of another one of said intake and exhaust valves, a second valve actuating piston received within, and closing, said third bore so as to be in opposing relationship to said valve stem of said another valve, and wherein said hydraulic path establishing means fluid-connects said first, second and third bores one to another.

3. A self-contained hydraulic valve timing system as in claim 2, wherein said means establishing said hydraulic path includes a branch passageway fluid connecting said second and third bores, and a main passageway having one end in fluid communication with said first bore, and another end in fluid communication with said branch passageway.

4. A self-contained hydraulic valve timing system as in claim 3, wherein said other end of said main passageway is fluid-connected to said branch passageway at a location which establishes a symmetrical pair of subpassageways thereof.

5. A self-contained hydraulic valve timing system as in claim 1, further comprising a rocker arm shaft, and a rocker arm pivotally connected to said rocker arm shaft, said rocker arm having an end opposite said rocker arm shaft in contactable relationship to valve stems associated with at least a pair of intake or exhaust valves and interposed between said valve pair and said valve actuating piston means, wherein said valve actuating piston means contacts said one end of said rocker arm so as to responsively cause substantially simultaneous opening of said valve pair.

6. A modular self-contained hydraulic valve timing system for variably controlling the timing and duration of opening of a number of valves in an internal combustion engine, said system comprising:

a valve cover integrally including a case;

cam follower piston means slidably received within said case and defining a working chamber therewithin for following a profile of a rotatable cam;

a number of valve actuator pistons each slidably received within said case and defining a respective actuating chamber therewithin for opening respective ones of said valves;

means establishing within said case a fluid passageway which fluid connects said working chamber with each said actuating chambers and thereby establishes a hydraulic transfer path therebetween;

solenoid valve means operable to establish a solid hydraulic link between said cam follower piston and said valve actuator pistons during a predetermined region of said cam profile so as to transfer movements of said cam follower piston simultaneously to each said valve actuator pistons; and a control passageway which fluid connects said passageway defining means, and thus said working and actuating chambers, to said solenoid valve, wherein said solenoid valve means includes (i) a first state which allows said cam follower piston means, during a portion of said cam profile in advance of said predetermined region being followed thereby, to be collapsibly displaced within said working chamber without said collapsible displacement being hydraulically transferred, via said hydraulic transfer path, to said valve actuating pistons, and (ii) a second state which establishes said solid hydraulic link between said cam follower piston means and said valve actuating pistons during said predetermined region of said cam profile such that continued collapsible displacement of said cam follower piston means during said predetermined region of said cam profile being followed thereby is hydraulically transferred, via said hydraulic transfer path, to cause said valve actuating pistons to be responsively displaced within said respective actuating chambers and into operative engagement with said respective ones of said valves thereby opening the same, wherein the timing and duration of said respective valve opening is achieved.

7. A self-contained hydraulic valve timing system as in claim 6, wherein said passageway establishing means includes a branch passageway which fluid connects an adjacent pair of said actuating chambers, and a main passageway which fluid connects said working chamber to said branch passageway such that first and second branches of said branch passageway are symmetrically disposed relative to said main passageway.

8. A modular self-contained hydraulic valve timing system for variably controlling the timing and duration of opening of a number of valves in an internal combustion engine, said system comprising:

a valve cover integrally including a case;

a cam follower piston means adapted to following a profile of a rotatable cam, said cam follower piston means being slidably received within said case and defining a working chamber therewithin so that said cam follower piston means is collapsibly movable within said working chamber in response to following a portion of said cam profile;

valve actuator piston means slidably received within said case and defining an actuating chamber therewithin for opening said number of valves;

means establishing within said case a fluid passageway which fluid connects said working chamber with each said actuating chambers and thereby establishing a hydraulic transfer path therebetween;

solenoid valve means operable to establish a solid hydraulic link between said cam follower piston means and said valve actuator piston means so that said collapsing movement of said cam follower piston means is hydraulically transferred to said valve actuating piston means to cause the same to extend from said valve actuating chamber; and rocker arm means having an end disposed between said number of valves and said valve actuating piston means, said rocker arm means pivoting in response to said extension of said valve actuating piston means to simultaneously cause opening of said number of valves, and wherein said solenoid valve means includes (i) a first state which allows said cam follower piston means, during a predetermined first segment of said cam profile portion being followed thereby, to be collapsibly moved within said working chamber without said collapsible movement being hydraulically transferred, via said hydraulic transfer path, to said valve actuating piston means, and (ii) a second state which establishes said solid hydraulic link between said cam follower piston means and said valve actuating piston means during a subsequent second movement of said cam profile portion, such that continued collapsible movement of said cam follower piston means during said second movement of said cam profile portion being followed thereby is hydraulically transferred, via said hydraulic transfer path, to cause said valve actuating piston means to be responsively extended from said valve actuating chamber and into operative engagement with said rocker arm means, wherein the timing and duration of opening of said valves is achieved.

9. A self-contained hydraulic valve timing system as in claim 8, wherein said rocker arm means includes a rocker arm shaft, a rocker arm mounted to said shaft for pivotal movements thereabout, said rocker arm having a pair of arm members, and an end member transversely joining said pair of arm members and operatively engageable with said valve stems of said number of valves, wherein said extension of said valve actuator piston means causes operative engagement between said valve actuator piston means and said end member, thereby responsively causing said rocker arm to pivot and simultaneously open said number of valves.

10. A self-contained hydraulic valve timing system as in claim 9, further comprising a solenoid valve operable to establish a solid hydraulic link between said cam follower piston means and valve actuator piston means so as to transfer collapsing movement of said cam follower piston means within said working chamber into extension of said valve actuator piston means from said valve actuating chamber; and a control passageway which fluid connects said passageway defining means, and thus said working and actuating chambers, to said solenoid valve.

11. In an internal combustion engine which includes a number of combustion cylinders each having at least one intake valve and one exhaust valve, and a rotatable cam shaft normally positioned in an in-line relationship over said intake and exhaust valves of said number of cylinders so as to control opening of the same, the improvement comprising a self-contained hydraulic valve timing system for variably controlling the opening timing and duration of said intake and exhaust valves of said number of cylinders, said system comprising a valve cover operatively coupled to said engine in covering relationship to said intake and exhaust valves of said engine cylinders as a replacement for said cam shaft normally associated with said internal combustion engine, said valve cover including:

a replacement cam shaft having a a number of cams associated with said intake and exhaust valves of said engine;

means for mounting said replacement cam shaft in vertical spaced in-line relationship to said intake and exhaust valves to allow said cams thereof to rotate about an axis established by said replacement cam shaft;

a number of hydraulic lifter means operatively positioned between a respective one of said cams and said intake and exhaust valves, said lifter means each including a cam follower piston and a valve actuating piston;

means forming a fluid passageway in said valve cover which fluid connects at least one pair of said hydraulic lifter means; and solenoid valve means in fluid communication with said fluid passageway for establishing a solid hydraulic link of variable timing and duration within a predetermined one of said hydraulic lifter means to thereby responsively open said respective inlet or exhaust valves, wherein timing and duration of said respective inlet or exhaust valves is controlled.

* * * * *